US010457040B2

(12) United States Patent
Van Der Heyden et al.

(10) Patent No.: US 10,457,040 B2
(45) Date of Patent: Oct. 29, 2019

(54) ELECTRONIC CIRCUIT FOR DRIVING AN ARRAY OF INKJET PRINT ELEMENTS

(71) Applicant: Océ-Technologies B.V., Venlo (NL)

(72) Inventors: Ralph Van Der Heyden, Venlo (NL); Cor Venner, Venlo (NL); Hylke Veenstra, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/850,089

(22) Filed: Dec. 21, 2017

(65) Prior Publication Data

US 2018/0111369 A1 Apr. 26, 2018

Related U.S. Application Data

(63) Continuation of application No. PCT/EP2016/064527, filed on Jun. 23, 2016.

(30) Foreign Application Priority Data

Jun. 29, 2015 (EP) ..... 15174229
Feb. 18, 2016 (EP) ..... 16156242

(51) Int. Cl.
*B41J 2/045* (2006.01)

(52) U.S. Cl.
CPC ..... *B41J 2/04541* (2013.01); *B41J 2/0455* (2013.01); *B41J 2/0459* (2013.01); (Continued)

(58) Field of Classification Search
CPC ..... B41J 2/04581; B41J 2/04588
See application file for complete search history.

(56) References Cited

U.S. PATENT DOCUMENTS 4,369,455 A * 1/1983 McConica ..... B41J 2/04581 310/317
5,475,405 A * 12/1995 Widder ..... B41J 2/04528 347/14

(Continued)

OTHER PUBLICATIONS

International Search Report, issued in PCT/EP2016/064527, PCT/ISA/210, dated Sep. 15, 2016.

(Continued)

*Primary Examiner* — Shelby L Fidler
(74) *Attorney, Agent, or Firm* — Birch, Stewart, Kolasch & Birch, LLP

(57) ABSTRACT

An electronic circuit for driving an inkjet print element in an array of print elements with an electric waveform is provided. The print element includes a piezo transducer for converting the electric waveform in a mechanical displacement. The electric waveform is tunable for an individual print element. The circuit includes a common waveform generator that is connected to the piezo transducer through a first print data dependent switch for providing an electric waveform independent of the print element. The circuit further includes a waveform tuning part, dependent on the print element and the print data, for controlling a second switch that adds electric energy from a voltage source to the electric waveform. The switches are operable in either a saturation state or a blocking state to limit an amount of dissipation in the switches.

8 Claims, 2 Drawing Sheets

(52) U.S. Cl.
CPC ..... *B41J 2/04536* (2013.01); *B41J 2/04581* (2013.01); *B41J 2/04588* (2013.01); *B41J 2/04591* (2013.01); *B41J 2/04593* (2013.01); *B41J 2/04596* (2013.01)

(56) References Cited

U.S. PATENT DOCUMENTS

| | | | | |
|---|---|---|---|---|
| 6,286,923 | B1 | 9/2001 | Sugahara | |
| 2002/0145637 | A1* | 10/2002 | Umeda | B41J 2/04541 347/9 |
| 2004/0066425 | A1 | 4/2004 | Togashi et al. | |
| 2006/0092201 | A1* | 5/2006 | Gardner | B41J 2/04508 347/10 |
| 2007/0030297 | A1* | 2/2007 | Norigoe | B41J 2/04581 347/11 |
| 2007/0076022 | A1* | 4/2007 | Takizawa | B41J 2/04505 347/5 |
| 2012/0262512 | A1 | 10/2012 | Oshima et al. | |
| 2014/0210884 | A1 | 7/2014 | Rosario et al. | |
| 2015/0072458 | A1* | 3/2015 | Goto | H01L 51/56 438/46 |

OTHER PUBLICATIONS

Written Opinion of the International Searching Authority, issued in PCT/EP2016/064527, PCT/ISA/237, dated Sep. 15, 2016.

* cited by examiner

ELECTRONIC CIRCUIT FOR DRIVING AN ARRAY OF INKJET PRINT ELEMENTS

CROSS-REFERENCE TO RELATED APPLICATIONS

This application is a Continuation of PCT International Application No. PCT/EP2016/064527, filed on Jun. 23, 2016, which claims priority to European Patent Application No. 15174229.3, filed on Jun. 29, 2015 and to European Patent Application No. 16,156,242.6, filed on Feb. 18, 2016, all of which are hereby expressly incorporated by reference into the present application.

BACKGROND OF THE INVENTION

1. Field of the Invention

The invention relates to an electronic circuit for driving an inkjet print element in an array of print elements with an electric waveform. In particular, the invention relates to a circuit that enables a selection of a tunable waveform in dependence of a print element. Furthermore, the invention relates to a print head module for jetting ink drops.

2. Description of the Related Art

High volume printers which are capable of printing more than 300 A4 size full color pages are known. These employ a single pass inkjet printing process wherein multiple print heads are combined to one page wide printing array to achieve a required performance. A small droplet size (<10 pl (picoliter)) and a high nozzle density (>600 npi (nozzles per inch)) are used to obtain a satisfactory print quality.

Contemporary print heads using piezo-electric actuators in the print elements are operated at jetting frequencies of several tens of kHz. After actuation with an appropriate electric signal, or waveform, the piezo actuator that is mounted to a channel filled with ink, causes a liquid droplet of ink or the like to be discharged from a nozzle at the end of the channel. After an ejection of a droplet the print element is preferably in a condition to eject a further droplet, although it may take some time to stabilize the print element. It is known to add a second part to a waveform to expedite this stabilisation process.

Droplet uniformity, which relates to variations in a size and a speed of the droplet, depends critically on the geometry and dimensions of the channel and the way it is actuated by the waveform. In particular, the waveform may be tuned to an individual print element by measuring a response to an actuation. This response is obtained either by directly measuring the droplet properties or by determining of the residual ink movement in the channel, such as the position of the meniscus in the nozzle, or by monitoring a dot that results from the droplet reaching a substrate. The electronic circuits that are used to drive a print head with individual waveforms for each print element, typically use a linear class AB type of amplifiers to generate the actuation waveform.

For the electronic circuit the piezo-electric actuator behaves in first order as a capacitive load, causing the waveform generator to dissipate an amount of energy proportional to the capacitance and the square of the applied voltage. Since each print element requires a dedicated generator having the ability to tune the waveform to the related element, the power dissipation in the generator increases significantly with an increasing density of print elements in a print head. Thus, there is a problem in obtaining an electronic circuit that is capable of applying an individually tunable waveform for each piezo actuator in a print head without getting the related power dissipation in the waveform generator.

SUMMARY OF THE INVENTION

According to the present invention, there is provided an electronic circuit for driving an inkjet print element in an array of print elements with an electric waveform, a print element comprising a piezo transducer for converting the electric waveform in a mechanical displacement, the electric waveform being tunable for an individual print element, the circuit comprising a common waveform generator that is connected to the piezo transducer through a first print data dependent switch for providing a common electric waveform, independent of the print element, and the circuit further comprising a waveform tuning part, dependent on the print element and the print data, for controlling a second switch that adds electric energy from a fixed voltage source to the electric waveform, wherein the switches are operable in either a saturation state or a blocking state to limit an amount of dissipation in the switches.

It is well known that a switch in the form of a transistor may operate in three states: a blocking, a conducting and a saturation state. In ordinary driver circuits, an individualized waveform is generated and amplified by transistors in a conducting state in order to obtain a required voltage for delivering energy in the actuator, which causes dissipation in these circuits. In a blocking state, no current is passed to the actuator load, so no dissipation is generated. In a saturation state, no voltage difference across the switch occurs and thus no dissipation is generated. According to the invention, the waveform tuning part is obtained from a fixed voltage source which is switched into connection with the actuator load during a short time of the waveform. Only during the alteration of the voltage across the actuator, power proportional to the square of the voltage difference is dissipated. This voltage difference, stemming from the fixed voltage source, is rather small as it is only related to a tuning part of the complete waveform. The tuning itself is realized by adjusting the amount of time this fixed voltage is applied. Thus the power in the circuit is reduced compared to tuning by voltage adjustment.

In a preferred embodiment, the fixed voltage source has a lower voltage than the peak voltage from the common waveform generator. Thus electric energy is removed from the capacitive load by the fixed voltage source. The tuning part then involves only one voltage alteration instead of two, as in the general situation, and the dissipated power in the tuning circuit is reduced by a factor of two.

In a further embodiment, the tuning part further depends on the print data of neighbouring print elements. With the high integration density, the print elements do not operate completely independently. Thus, the tuning of the waveform may be used to compensate for the possible actuation of neighbouring print elements.

In a further embodiment, a third switch is provided to the print element for adding electric energy in a second part of the waveform. In addition to a first switch for applying the fixed waveform for actuating a print element and a second switch for applying a tuning part to a driving pulse of the waveform, a third switch may be used to add electric energy to a part of the waveform that stabilizes the print element. In this case the waveform comprises two pulses of opposite polarity, or in some cases equal polarity, wherein the second part, or brake pulse, is also tuned to perform optimally.

Further details of the invention are given in the dependent claims. The present invention may also be embodied in a print head module comprising a print head chip and a driver board, connected by a module comprising an electronic circuit as described.

The present invention further comprises a method for adapting an electric waveform for actuating a print element in an array of print elements to eject an ink drop, the waveform comprising a first pulse independent of the specific print element and further comprising a second pulse that is added to the first pulse, the second pulse having a fixed strength and a tunable duration, such that a property of the ink drop resulting from the actuation by the electric waveform is varied. A property of the ink drop that is relevant in the print process is its volume velocity, which determines the size of a dot that materializes when the ink drop hits the substrate underneath the print elements. Another property of the ink drop is its velocity. In order to make these properties more uniform across the various print elements in the array, it may be necessary to tune the electric waveform in the indicated way.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF EMBODIMENTS

Figure 1:
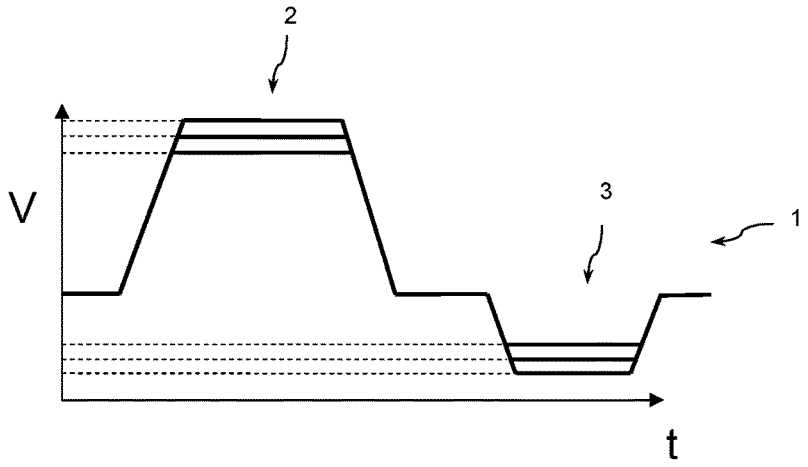
Fig. 1 (prior art)
FIG. 1 illustrates a tunable waveform as known in the prior art.

The present invention will now be described with reference to the accompanying drawings, wherein the same or similar elements are identified with the same reference numeral.

FIG. 1 shows a waveform 1 comprising two parts, or two pulses, as is known in the prior art. The waveform takes a time in the order of 5 to 25 us (microseconds) and a maximum voltage is of the order of 30 to 80 V (Volts). A first pulse 2, the jet pulse, is applied to a piezo actuator of a print element for ejecting an ink drop from a nozzle in the print element. A second pulse 3, the brake pulse, is applied to reduce the residual vibrations of the ink inside the print element. Both pulses are tunable in respect to the maximum voltage to adjust the velocity and volume of the ejected droplet and to adjust the effectivity of the brake pulse respectively. It is noted that the waveform 1 may deform somewhat by the capacitive load of the piezo actuator.

Figure 2:
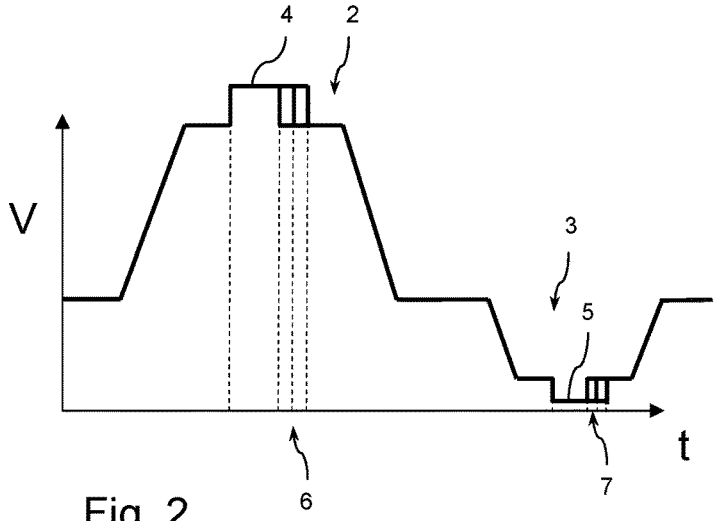
FIG. 2 shows a tunable waveform according to the present invention.

FIG. 2 shows a waveform as applied by the circuit according to the present invention. In this waveform the jet pulse 2 and brake pulse 3 are composed of a basic part that is independent of the print element. In addition to this basic part an extra voltage 4 and an extra voltage 5 are supplied to the capacitive load. Both extra voltages have a variable duration 6 and 7, thereby tuning the deformation of the piezo actuator and the energy supplied to the ink in the print element.

Figure 3:
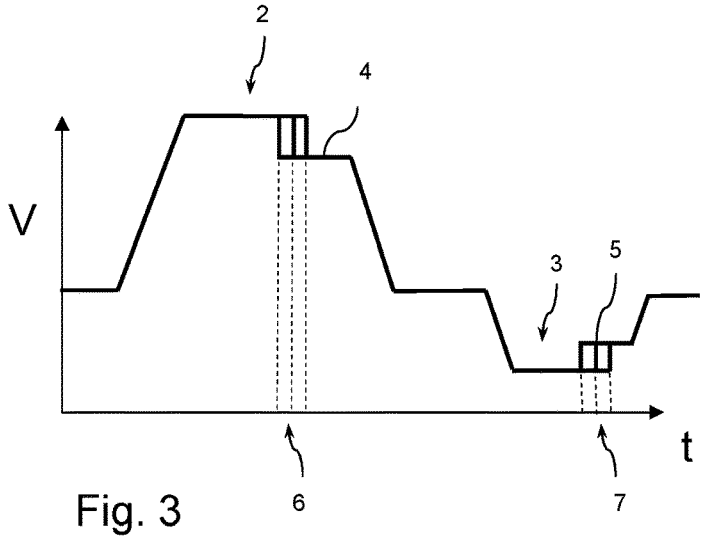
FIG. 3 shows a preferred shape of the tunable waveform.

FIG. 3 shows a preferred waveform wherein the extra voltage has a lower voltage than the peak voltage from the common waveform generator, both in the jet pulse 2 and in the brake pulse 3. Since there is only one alteration of the voltage at a variable timing 6 and 7, the power dissipated in the tuning part of the circuit is reduced by a factor of two relative to the waveform shown in FIG. 2.

Figure 4:
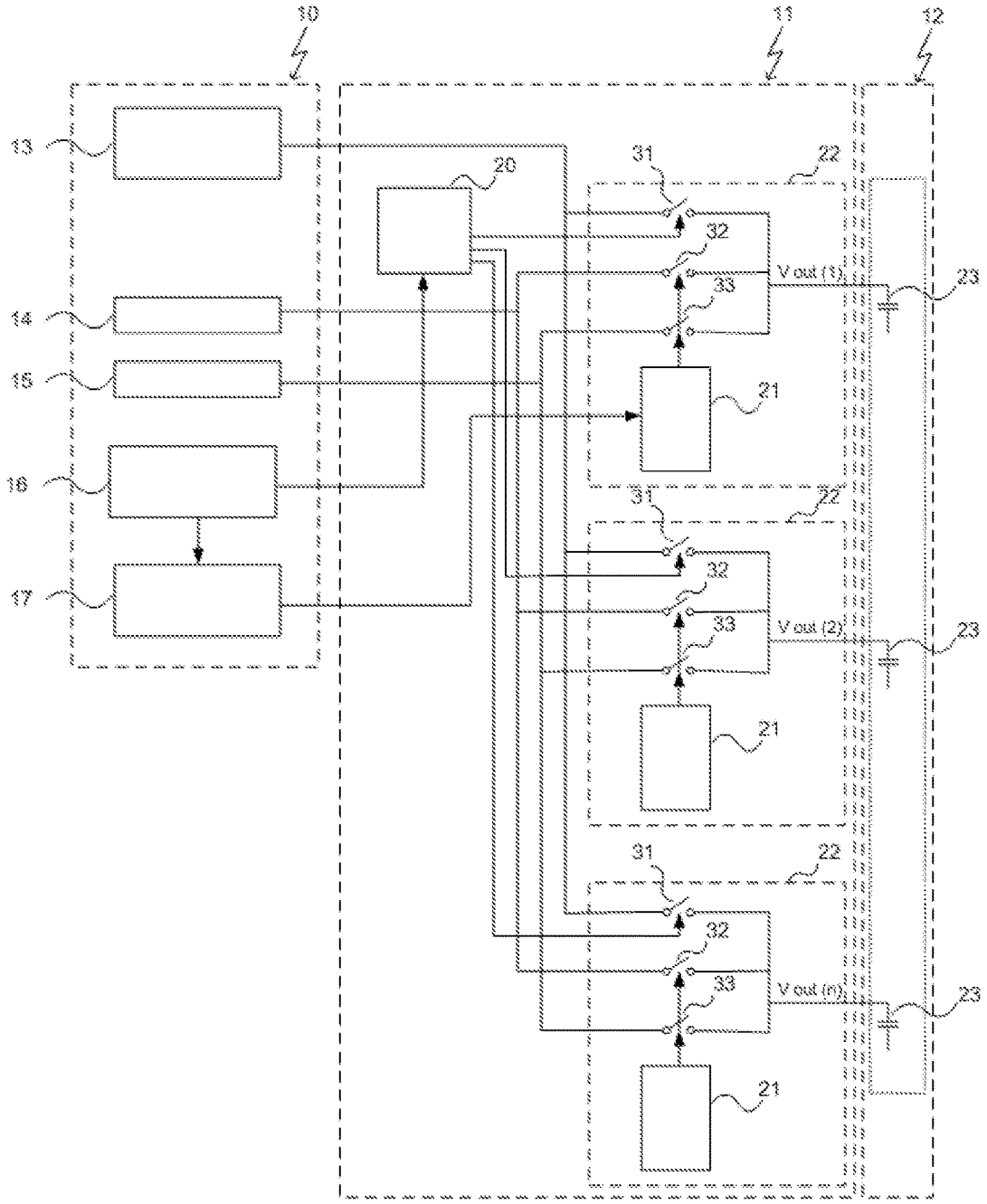
FIG. 4 is an embodiment of an electronic circuit that provides the intended tunable waveform.

FIG. 4 is a print head module wherein print elements are actuated according to the waveform of FIG. 2 or FIG. 3. It comprises a print head driver board 10, a driver ASIC 11 and a print head chip 12 comprising print elements 23, each print element having a piezo electric actuator for transforming an electric voltage to an acoustic wave in the ink of the element. The piezo actuator is electrically a capacitive load for the electronic circuit.

The driver board 10 comprises a common waveform generator 13 that generates a basic waveform independent of a specific print element. Two fixed voltage sources, 14 and 15, are on the board to be used for supplying the extra voltages 4 and 5 in the waveform. A print data memory 16 is available for the wave shape selection module 17 that specifies the timing 6 and 7 for tuning the waveform to the individual print elements 23. A driver ASIC 11 is positioned as close as possible to the print head 12 in order to reduce parasitic effects. The ASIC 11 comprises a main switch control 20 and a switch module 22 for each print element. Each switch module 22 comprises a tune switch control 21 and three transistor switches 31, 32 and 33. The main switch control 20 determines from the print data 16, the timing of the first switch 31 for connecting the basic part of the waveform generated by generator 13 to a print element. The wave shape selection module 17 supplies the parameters for the tune switch control 21 to determine the timing to bring the switches 32 and 33 from their open, blocking state into a closed, saturation state. These transistors are therefore not operated in a conducting state, which limits the dissipation that they provide. The resulting voltage supplied to the print element 23 is a summation of a number of fixed sources controlled by the various switches to obtain an actuation that is individually tunable for each print element.

The skilled person will recognise that other embodiments are possible within the scope of the appended claims.

The invention being thus described, it will be obvious that the same may be varied in many ways. Such variations are not to be regarded as a departure from the scope of the invention, and all such modifications as would be obvious to one skilled in the art are intended to be included within the scope of the following claims.

What is claimed is:

1. An electronic circuit for driving an inkjet print element in an array of print elements with an electric waveform, the inkjet print element comprising a piezo transducer for converting the electric waveform in a mechanical displacement, the electric waveform being tunable for an individual print element, the electronic circuit comprising:

a common waveform generator connected to the piezo transducer through a first print data dependent switch for providing a common electric waveform, independent of the inkjet print element; and a waveform tuning part, dependent on the print element and the print data, for controlling a second switch that adds electric energy from a fixed voltage source to the common electric waveform, wherein the first and second switches are operable in either a saturation state or a blocking state to limit an amount of dissipation in the first and second switches.

2. The electronic circuit according to claim 1, wherein the fixed voltage source has a lower voltage than a peak voltage from the common waveform generator.

3. The electronic circuit according to claim 1, wherein the waveform tuning part further depends on the print data of neighbouring print elements.

4. The electronic circuit according to claim 1, wherein the waveform tuning part further depends on the print data associated with previous waveforms.

5. The electronic circuit according to claim 1, wherein a third switch is provided to the inkjet print element for adding electric energy in a second part of the electric waveform.

6. The electronic circuit according to claim 1, wherein the waveform tuning part comprises timing parameters for controlling the second switch.

7. A print head module comprising:

a print head chip: and a driver board, wherein the print head chip and the driver board are connected by a module comprising the electronic circuit according to claim 1, and wherein the print head chip comprises the array of print elements, the print head module comprises the first and second switches for applying the electric waveform to the print elements, and the driver board comprises the common waveform generator and the fixed voltage source.

8. The print head module according to claim 7, wherein the driver board further comprises a memory for saving waveform tuning parameters for a print element of the array of print elements.

* * * * *